US007404613B2

(12) United States Patent
Kwan et al.

(10) Patent No.: US 7,404,613 B2
(45) Date of Patent: Jul. 29, 2008

(54) INKJET PRINT CARTRIDGE HAVING AN ADHESIVE WITH IMPROVED DIMENSIONAL CONTROL

(75) Inventors: Kin Ming Kwan, Lexington, KY (US); James Michael Mrvos, Lexington, KY (US); Jeanne Marie Saldanha Singh, Lexington, KY (US); Mary Claire Smoot, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 444 days.

(21) Appl. No.: 11/169,905

(22) Filed: Jun. 29, 2005

(65) Prior Publication Data

US 2006/0001713 A1 Jan. 5, 2006

Related U.S. Application Data

(60) Provisional application No. 60/584,520, filed on Jun. 30, 2004.

(51) Int. Cl.
*B41J 2/015* (2006.01)
*B41J 2/175* (2006.01)

(52) U.S. Cl. ..... 347/20; 347/87

(58) Field of Classification Search ..... 347/20, 347/50, 58, 63, 64, 87
See application file for complete search history.

(56) References Cited

U.S. PATENT DOCUMENTS 4,680,859 A 7/1987 Johnson
4,935,750 A 6/1990 Hawkins
5,278,584 A * 1/1994 Keefe et al. ..... 347/63
5,427,642 A 6/1995 Akiguchi et al.
5,435,961 A 7/1995 Micciche (Continued)

FOREIGN PATENT DOCUMENTS

EP 0867293 9/1998

(Continued)

OTHER PUBLICATIONS

U.S. Appl. No. 10/679,070, filed Oct. 2003, Smoot.

*Primary Examiner*—Anh T. N. Vo
(74) *Attorney, Agent, or Firm*—Taft, Stettinius & Hollister LLP

(57) ABSTRACT

A method for manufacturing an inkjet print cartridge and an inkjet cartridge produced thereby are disclosed. An inkjet print cartridge in accordance with one aspect includes a component of the inkjet print cartridge and an applied adhesive on at least a portion of the component, wherein the applied adhesive is formed from an adhesive having a rheology viscosity ratio $\eta_i/\eta_{min}$ of from 1.0 to less than 2.1. The method in accordance with one aspect includes applying an adhesive onto at least a portion of a component of an inkjet print cartridge at an application temperature, $T_\alpha$, and heating the adhesive from an initial temperature, $T_i$, to a cure temperature for the adhesive, $T_c$. The adhesive has a rheology cure profile characterized by at least one of the following parameters: a) a rheology viscosity ratio $\eta_i/\eta_{min}$ of from 1.0 to less than 2.1, b) a temperature of the adhesive is approximately equal to a minimum viscosity temperature for the adhesive, $T_{\eta min}$, within less than about 10 minutes from the start of the cure cycle, and c) viscosity of the adhesive increases within less than about 5 minutes from the start of the cure cycle.

30 Claims, 5 Drawing Sheets

U.S. PATENT DOCUMENTS 5,442,386 A * 8/1995 Childers et al. ..... 374/50
5,450,113 A 9/1995 Childers et al.
5,478,700 A 12/1995 Gaynes et al.
5,515,089 A 5/1996 Herko et al.
5,519,421 A * 5/1996 Barr et al. ..... 347/47
5,538,586 A 7/1996 Swanson et al.
5,539,153 A 7/1996 Schwiebert et al.
5,596,172 A 1/1997 Raskin et al.
5,627,108 A 5/1997 Alibocus et al.
5,669,970 A 9/1997 Balog et al.
5,736,998 A 4/1998 Caren et al.
5,807,606 A 9/1998 Mould et al.
5,905,513 A 5/1999 Brandon et al.
5,953,032 A * 9/1999 Haarz et al. ..... 347/87
5,980,682 A 11/1999 Gibson et al.
6,010,208 A 1/2000 Powers et al.
6,067,709 A 5/2000 Godin et al.
6,076,912 A 6/2000 Murthy
6,089,151 A 7/2000 Cobbley et al.
6,098,257 A 8/2000 Koido et al.
6,113,216 A 9/2000 Wong
6,184,291 B1 2/2001 Ahmed et al.
6,210,522 B1 4/2001 Singh et al.
6,230,619 B1 5/2001 Yamazaki et al.
6,244,696 B1 6/2001 Tran et al.
6,253,675 B1 7/2001 Mayer
6,260,957 B1 7/2001 Corley, Jr. et al.
6,264,317 B1 7/2001 Raulinaitis et al.
6,267,472 B1 7/2001 Maher et al.
6,290,340 B1 9/2001 Kitahara et al.
6,328,423 B1 12/2001 Wong et al.
6,357,864 B1 3/2002 Sullivan et al.
6,361,152 B1 3/2002 Fujisawa
6,371,017 B1 4/2002 Yamazaki et al.
6,380,511 B1 4/2002 Santhanam
6,386,434 B1 5/2002 Wong
6,409,312 B1 6/2002 Mrvos et al.
6,439,698 B1 8/2002 Patil
6,495,199 B1 12/2002 Kaiser et al.
6,508,170 B2 1/2003 Katsuoka et al.
6,590,285 B1 7/2003 Davis et al.
6,612,032 B1 9/2003 Murthy et al.
6,646,354 B2 11/2003 Cobbley et al.
6,649,403 B1 11/2003 McDevitt et al.
6,834,937 B2 * 12/2004 Killmeier et al. ..... 347/50
2001/0015744 A1 8/2001 Feinn et al.
2001/0043252 A1 11/2001 Feder et al.
2002/0051042 A1 5/2002 Takagi et al.
2002/0101482 A1 8/2002 Cook et al.
2002/0105562 A1 8/2002 Miyagawa et al.
2002/0128340 A1 9/2002 Young et al.
2002/0185482 A1 12/2002 Cobb et al.
2003/0097941 A1 5/2003 Rossmeisl et al.
2004/0089171 A1 5/2004 Jiang et al.

FOREIGN PATENT DOCUMENTS

EP 0888891 1/1999

* cited by examiner

INKJET PRINT CARTRIDGE HAVING AN ADHESIVE WITH IMPROVED DIMENSIONAL CONTROL

CROSS-REFERENCE TO RELATED APPLICATION

This patent application claims priority to U.S. provisional patent application No. 60/584,520 filed on Jun. 30, 2004, which is hereby incorporated by reference in its entirety.

FIELD OF THE INVENTION

The present invention relates to ink jet printing apparatus, such as printers, and, more particularly, to adhesives applied during ink jet printhead assembly characterized by improved dimensional control of the applied adhesive.

BACKGROUND OF THE INVENTION

Drop-on-demand thermal ink jet printers use thermal energy to produce a vapor bubble in an ink-filled chamber to expel a droplet. A thermal energy generator or heating element, usually a resistor, is located in the chamber on a heater chip near a discharge orifice. A plurality of chambers, each provided with a single heating element, are provided in the printer's printhead. The printhead typically comprises the heater chip and a nozzle plate having a plurality of the discharge orifices formed therein. The printhead forms part of an ink jet print cartridge which also comprises an ink-filled container.

The resistors are individually addressed with an energy pulse to momentarily vaporize the ink and form a bubble which expels an ink droplet. A flexible circuit is used to provide a path for energy pulses to travel from a printer energy supply circuit to the printhead. The flexible circuit includes a substrate portion and a plurality of traces located on the substrate portion. The traces have end sections which extend out from the substrate portion. The extending sections are coupled to bond pads on the printhead. Typically, there is a first row of coupled bond pads and trace sections and an opposing, second row of coupled bond pads and trace sections.

It is known in the art to form a barrier layer over each row of coupled bond pads and extending trace sections. One known process for forming such a barrier layer involves dispensing an encapsulant material onto the coupled bond pads and trace sections using a discharge needle. The final height of the barrier layer relative to the nozzle plate typically is undesirably high. As a result, a paper substrate, which receives the ejected ink droplets, is spaced an increased distance from the printhead orifice plate. Consequently, misdirected ink droplets reach the paper substrate at locations which are spaced a greater distance from their intended contact points than if the paper substrate were located closer to the printhead orifice plate. The excessive height of the barrier layer is further problematic as it makes it more difficult to apply a length of sealing tape to the printhead so as to seal the printhead orifices from ink leakage until the print cartridge is installed for use in a printer. Another potential problem associated with dispensing an encapsulant material with a discharge needle relates to improper location. Dispensing encapsulant in the wrong locations can result in unacceptable product because the encapsulant fails to provide the necessary coverage for the electrical components on the print cartridge or covers areas intended to be free of encapsulant such as for ink ejection or capping purposes.

The ability to properly place an adhesive having the proper dimensions is also an issue with respect to adhesives used for die attach, potting, etc. As the components used to manufacture the inkjet printheads undergo miniaturization, the assembly process faces many challenges in placing components with high precision and holding them under tight tolerances. Stencil printing is used in the electronics industry for solder paste deposition. The precision and holding accuracy of the final structure depends not only on the handling, placement capability of the equipment, and substrate properties but also on the material characteristics of the flux, adhesives or solder paste being used. For most materials, the flow and deformation characteristics both before and during cure are critical. Placement accuracy and final location of the chip become more critical as the die dimensions are miniaturized. Potting and encapsulation of TAB beams and interconnects are also affected when the adhesives have to be dispensed in smaller spaces and need to be held to tighter dimensional tolerances.

Flow properties of adhesives primarily depend on the chemical and physical structure and hence on their composition. Depending on the application, the requirements for flow and deformation of adhesives may be different. For example, non-contact needle dispense systems require the adhesive viscosity to be low enough that flow through the needle is sufficient. However, depending on the shapes and sizes to be filled, or placed, the adhesive may need to have specific properties with respect to flow-out, recovery and elasticity. For stencil printing, it is critical that the adhesive shear thins while filling the apertures. The adhesive must then recover and retain the shape, geometry and dimensions after printing. In addition to the above properties, if the material is a crosslinkable, thermosetting material, the cure parameters can affect the flow and deformation of the adhesive thereby dictating the final dimensions and tolerance. For thermally curable adhesives, the flow and deformation during curing under heat or heat and pressure affects the resulting dimensions. Therefore, in order to maintain tolerances for these placement and dimensions, it is important to have an adhesive with the appropriate rheology for the application before and during curing of an adhesive.

In an inkjet printhead assembly, it is critical to maintain the location of the chip after curing of the die attach adhesive. After the adhesive is dispensed or stencil or screen printed, the chip is aligned and placed on top of the adhesive before the adhesive is cured. During the cure, the chip location can shift depending on the rheology of the die attach adhesive under temperature and load. Another application wherein it is important to maintain adhesive location and dimensions is the encapsulation of TAB beams with a thermally curable adhesive. During the curing cycle of the encapsulant adhesive, the shape and dimensions of the adhesive bead may change. Proper location and dimensions are also important for applying an underfill material where it is essential that the material spreads and fills the chip cavity and may require flow characteristics very different from the die attach or the encapsulant materials.

Commonly assigned U.S. Pat. No. 6,439,698 describes a method of stencil printing an encapsulant material over electrical connections and other areas on an inkjet printhead. The encapsulant is applied to the electrical connections preferably in the form of a bead.

Commonly assigned U.S. patent application Ser. No. 10/679,070 describes a method of stencil printing an encapsulant material over electrical connections and other areas on an inkjet printhead.

SUMMARY OF THE INVENTION

The present invention relates to a method for manufacturing an inkjet print cartridge and to an inkjet cartridge produced thereby wherein an adhesive having particular characteristics is applied during assembly of the inkjet print cartridge so as to improve adhesive placement and dimensional control of the applied adhesive. In accordance with one aspect of the invention, the method includes applying an adhesive onto a portion of a component of an inkjet print cartridge.

The rheology cure profile for the adhesive provides an indication of how well the adhesive will maintain dimensions after application and during curing. The rheology cure profile for the adhesive is determined using a rheometer set up to simulate production conditions during manufacture of the inkjet print cartridge with respect to time and temperature for thermal curing of the adhesive. The adhesive has an initial viscosity, $\eta_i$ at the initial temperature, $T_i$, at the start of the cure cycle and a minimum viscosity, $\eta_{min}$, at a minimum viscosity temperature, $T_{\eta min}$, the minimum viscosity corresponding to the minimum viscosity over the temperature range of from $T_i$ to a cure temperature for the adhesive, $T_c$, and the rheology viscosity ratio $\eta_i/\eta_{min}$ is from 1.0 to less than about 2.1, more particularly from 1.0 to about 2.0 and still more specifically from 1 to about 1.5. In accordance with particular embodiments of the invention, the rheology viscosity ratio $\eta_i/\eta_{min}$ is approximately 1. To simulate actual cure conditions for a particular printhead construction as described herein, the viscosity can be measured over the specified temperature range with a temperature ramp rate of about 5.7° C./min. from $T_i$ to $T_c$ and held isothermal at $T_c$ for a period of time. Rheology profiles for other production conditions can be established to simulate the temperature changes with time that the adhesive experiences during the curing process.

In accordance with another aspect of the invention, dimensional control of the applied adhesive is obtained by subjecting the applied adhesive to a curing process so as to shorten the time required to reach the minimum viscosity for the adhesive. In accordance with this aspect of the invention, a method for manufacturing an inkjet print cartridge includes the steps of applying an adhesive to a component of an inkjet print cartridge such that the time to reach $T_{\eta min}$, is less than about 10 minutes, more particularly less than about 7 minutes and still more specifically from about 0 to 5 minutes as measured from the start of the cure cycle.

BRIEF DESCRIPTION OF THE DRAWINGS

Further advantages of the invention will become apparent by reference to the detailed description when considered in conjunction with the figures, which are not to scale, wherein like reference numbers indicate like elements through the several views, and wherein.

DETAILED DESCRIPTION

Figure 1:
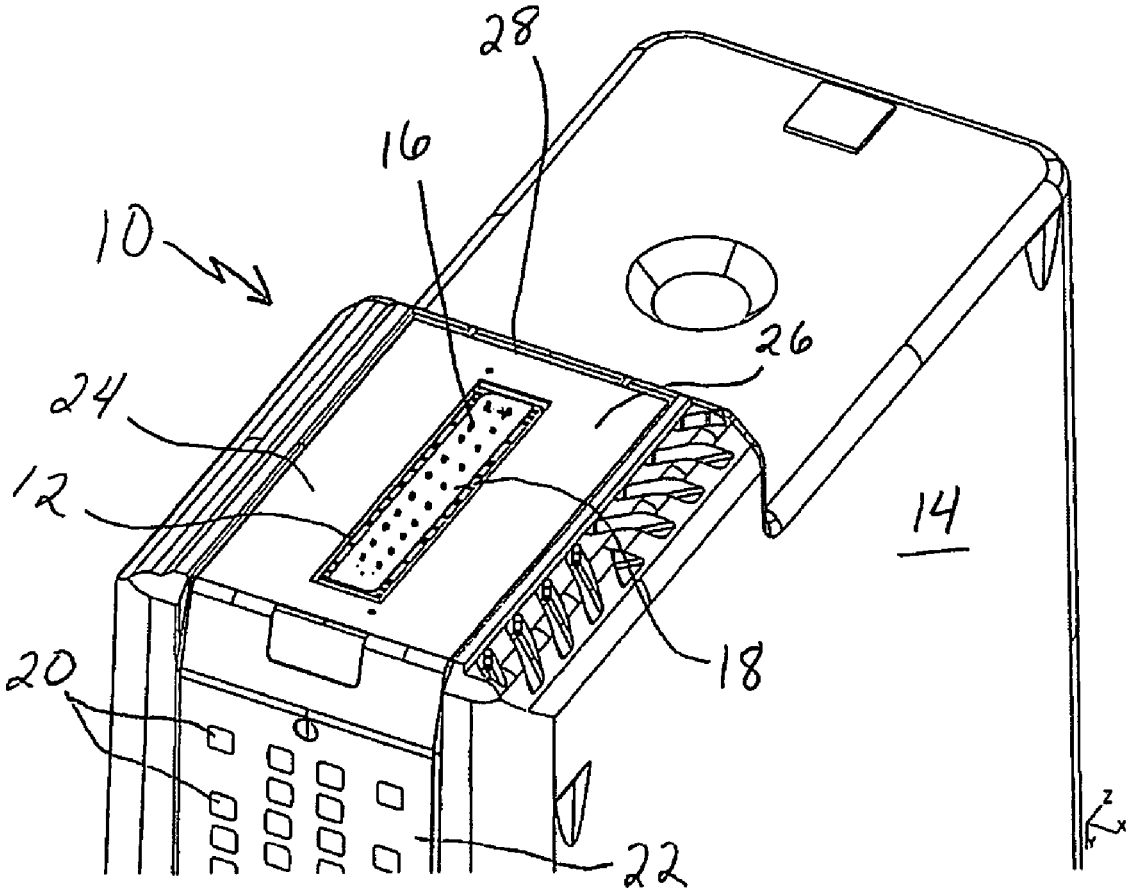
FIG. 1 is a perspective view of a portion of an ink jet print cartridge according to one aspect of the invention.

All documents cited are, in relevant part, incorporated herein by reference; the citation of any document is not to be construed as an admission that it is prior art with respect to the present invention.

The present invention will be described in more detail with reference to stencil printing a polymeric encapsulant over the electrical connections on the inkjet printhead. The invention is equally applicable to other dispense processes and other adhesives used in the manufacture of inkjet printheads. Examples of other dispense processes include, but are not limited to, needle dispense, screen printing, etc. Examples of other adhesives and applications include, but are not limited to, die attach adhesives, potting adhesives, underfill adhesives, etc.

The present application refers to adhesives for use in the production of inkjet printhead cartridges wherein the rheology cure profiles for the adhesives based on production conditions are indicative of improved dimensional control for the applied adhesive. The rheology cure profile indicates the viscosity of the adhesive over a period of time and at various temperatures wherein the period of time and temperatures are selected to simulate the process conditions relating to curing the adhesive after it is applied to a component of the cartridge and placed in an oven or other device to cure. Typically, the adhesive is applied at an application temperature, $T_\alpha$, and then heated to at or around the cure temperature at which point the adhesive is held isothermal to cure or crosslink the adhesive. Accordingly, the rheology cure profile parameters are variable and depend on the actual process conditions used to produce the printhead.

The term "application temperature" ($T_\alpha$) refers to the temperature of the adhesive immediately after being applied to the component of the inkjet cartridge. The term "initial temperature" ($T_i$) refers to the temperature of the adhesive at the start of the cure cycle, i.e., when the component is placed in the oven or other curing device. The term "initial viscosity" ($\eta_i$) as used herein refers to the viscosity of the adhesive at the initial temperature. The term "minimum viscosity" ($\eta_{min}$) refers to the minimum viscosity over the temperature range from the initial temperature to a cure temperature ($T_c$) for the adhesive as determined based on the rheology cure profile. The term "minimum viscosity temperature" ($T_{\eta min}$) refers to the temperature at which the minimum viscosity occurs. The term "cure temperature" ($T_c$) refers to the temperature to which the adhesive is heated to crosslink or cure the adhesive. As used herein, "minimum viscosity" and "minimum viscosity temperature" are determined based on the rheology cure profile for the process conditions and therefore can vary depending on the specific process variables. By way of example, the ramp rate at which the temperature is increased can affect the point at which the minimum viscosity occurs.

In general, the rheology cure profile will be determined over a temperature range from the initial temperature to the cure temperature at a ramp rate calculated based on Formula I below wherein ramp rate equals the difference in temperature between the cure temperature ($T_c$) and the initial temperature ($T_i$) divided by the time (t) to increase in temperature from the initial temperature to the cure temperature under the standard process conditions for curing the adhesive.

$$\text{Ramp Rate}=(T_c-T_i)/t \quad \text{(I)}$$

As used herein, the term "rheology viscosity ratio" ($\eta_i/\eta_{min}$) refers to the initial viscosity divided by the minimum viscosity as determined based on the rheology cure profile.

The term "ambient temperature" is understood here to mean a moderate temperature of approximately 20 to 25° C.

With reference to FIG. 1, there is shown, in perspective view, an ink jet print cartridge 10 including a heater chip/nozzle plate assembly 12 attached to a cartridge body 14. The cartridge body 14 is an ink-filled polymeric container containing one or more inks for feeding ink to the heater chip/nozzle plate assembly 12 for ejection of ink toward a print media from nozzle holes 16 on nozzle plate 18. Each ink jet print cartridge 10 may contain a single color ink, such as black, cyan, magenta or yellow or may contain multiple colors of ink using a plurality of heater chip/nozzle plate assemblies 12. In the illustration shown in FIG. 1, the ink jet print cartridge 10 contains one heater chip/nozzle plate assembly 12 for ejecting one color of ink.

In order to control the ejection of ink from the nozzle holes 16, the heater chip/nozzle plate assembly 12 is electrically connected to a print controller in the printer to which the print cartridge 10 is attached. Connections between the print controller and the print cartridge are provided by contact pads 20 which are disposed on a first portion 22 of a flexible circuit or tape automated bonding (TAB) circuit 24. Flexible circuits and TAB circuits are resilient polymeric films such as but not limited to polyimide films 24 which contain electrical traces thereon for conducting electrical signals from a source to a device connected to the traces of the flexible or TAB circuit 24. Accordingly, a second portion 26 of the flexible circuit or TAB circuit 24 is disposed on the operative side 28 of the cartridge body 14. The back side of the flexible circuit or TAB circuit 24 typically contains electrical traces which provide electrical continuity between the contact pads 20 and the heater chip/nozzle plate assembly 12 for controlling the ejection of ink from the nozzle plate 18. Electrical TAB bond or wire bond connections are made between the electrical traces and the heater chip/nozzle plate assembly 12 as described in more detail below.

Figure 2:
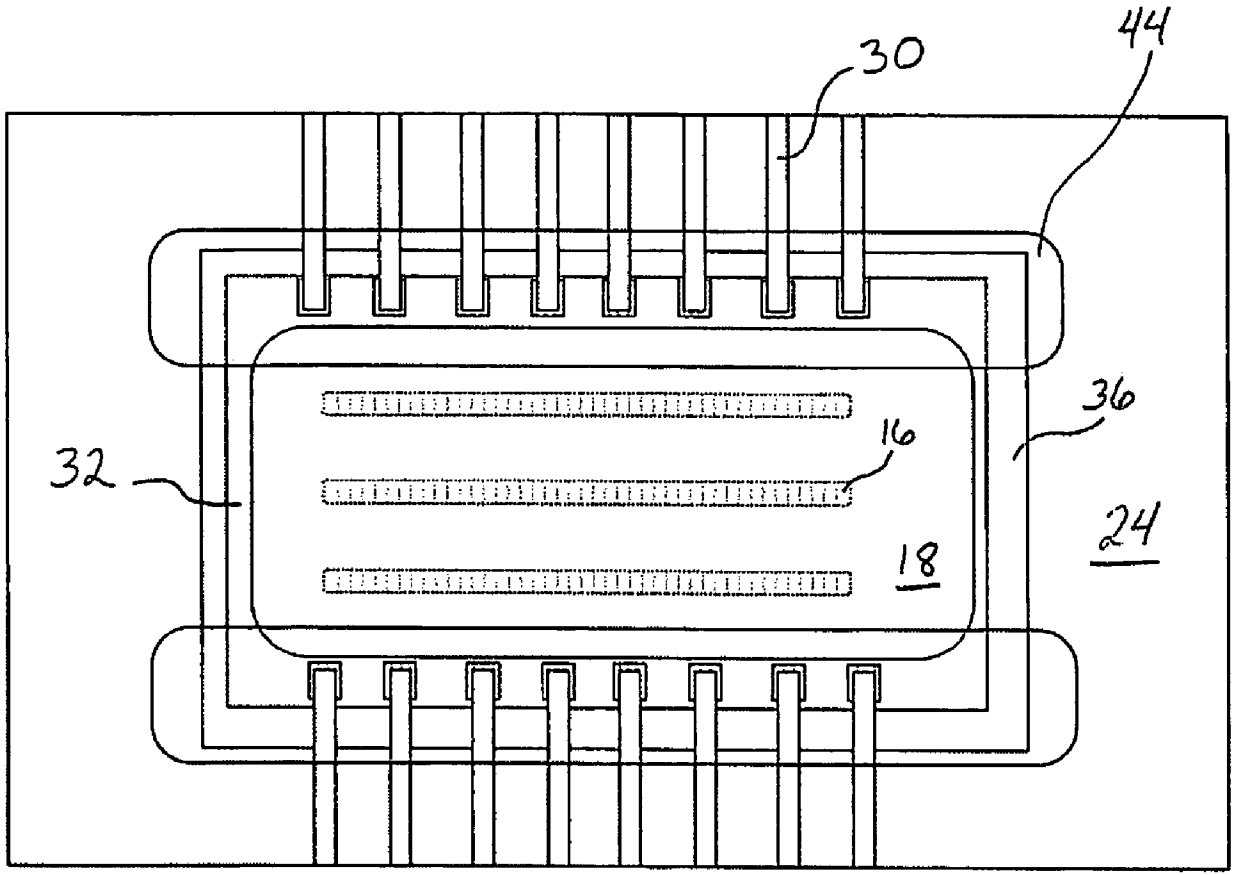
FIG. 2 is a plan view of a portion of an ink jet print cartridge containing an encapsulant material applied in accordance with one aspect of the invention.
Figure 3:
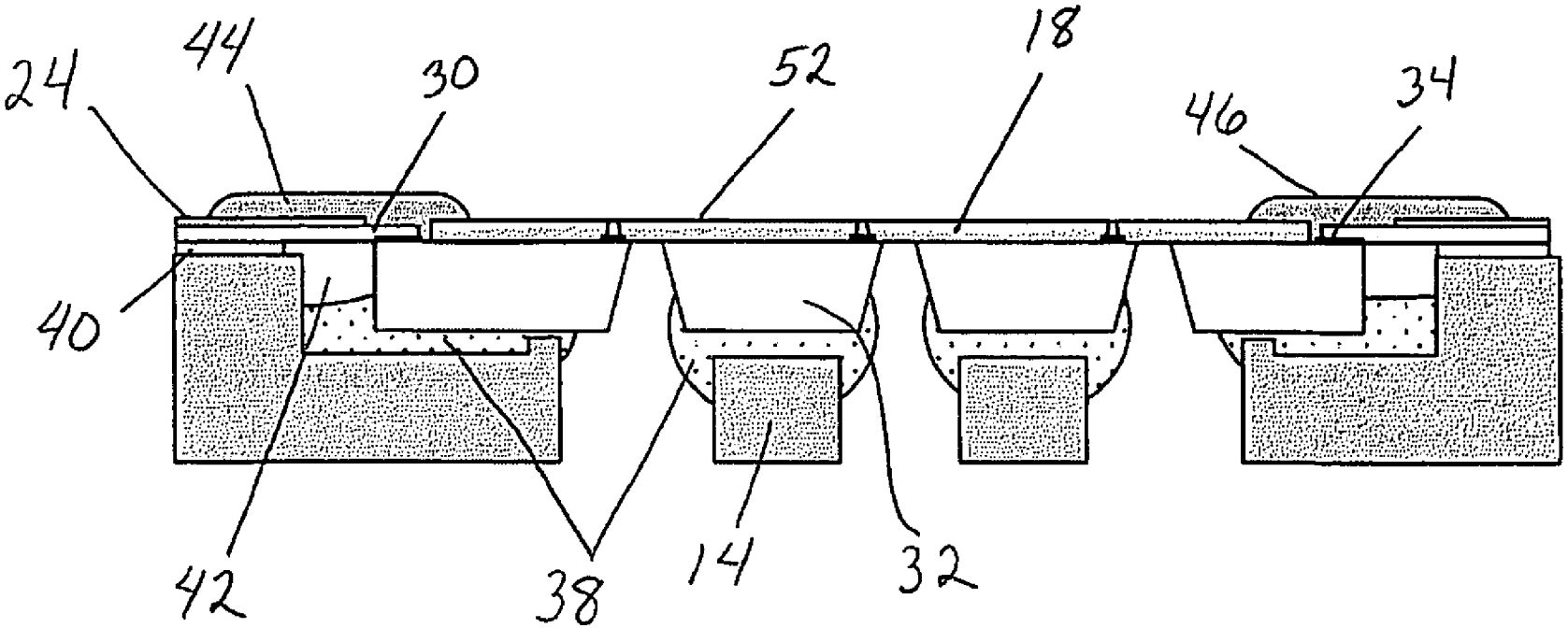
FIG. 3 is a cross-sectional side view of a portion of an ink jet print cartridge according to one aspect of the invention.
Figure 4:
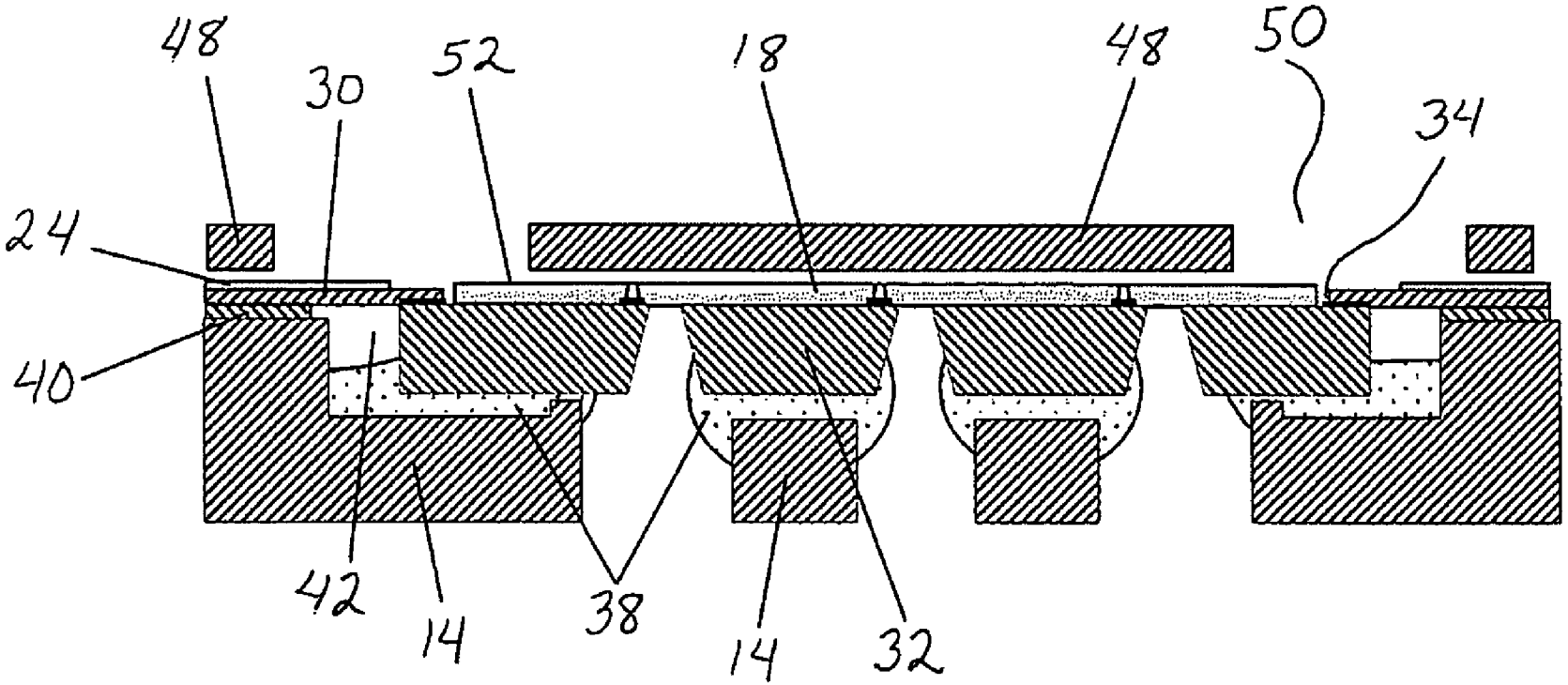
FIG. 4 is a cross-sectional view of a stencil aligned with an ink jet print cartridge in accordance with one aspect of the invention.

Connections between the flexible circuits or TAB circuits 24 and the heater chip/nozzle plate assembly 12 are shown in detail by reference to FIGS. 2, 3 and 4. As described above, the flexible or TAB circuits 24 contain electrical traces 30 which are electrically connected to a heater chip 32. The heater chip 32 contains resistors and/or other electronic devices for inducing ejection of ink through nozzle holes 16 of a nozzle plate 18 toward a print media, typically paper. Connection pads (not shown) on the flexible or TAB circuits 24 are connected to bond pads 34 on the heater chip 32 either by TAB bonding techniques or by use of wires using a wire bonding procedure.

As shown in FIG. 3, the heater chip 32 is attached to the cartridge body 14, preferably in a chip pocket. Prior to attaching the chip 32 to the cartridge body 14, a nozzle plate 18 is attached to the chip 32. The heater chip/nozzle plate assembly 12 in FIG. 1 refers to the assembly provided by the heater chip 32 attached to the nozzle plate 18.

The chip 32 and nozzle plate 18 may be attached using any art recognized bonding techniques including a thermo compression bonding technique. The nozzle plate 18 may be formed from polymeric materials such as, but not limited to, polyimide, polyester, fluorocarbon polymer, epoxy, or polycarbonate. Examples of commercially available nozzle plate materials include polyimide materials available under the trademarks UPILEX and KAPTON available from Ube (of Japan) and E.I. DuPont de Nemours & Co., respectively.

An adhesive (not shown) may be used to secure the nozzle plate 18 to the heater chip 32. The adhesive may be a heat curable adhesive such a B-stage thermal cure resin, including, but not limited to phenolic resins, resorcinol resins, epoxy resins, ethylene-urea resins, furane resins, polyurethane resins and silicone resins. The adhesive is preferably cured before attaching the chip to the cartridge body and the adhesive preferably has a thickness ranging from about 1 to about 25 microns.

After bonding the nozzle plate 18 and chip 32 together, the chip/nozzle plate assembly 12 is attached to the cartridge body 14 in chip pocket 36 using a die attach adhesive 38. The die attach adhesive 38 is preferably an epoxy adhesive such as a die attach adhesive available from Emerson & Cuming of Monroe Township, N.J. under the trade name ECCOBOND 3193-17. In accordance with one aspect of the present invention, the adhesive is stencil or screen printed or dispensed in the chip pocket 36 thereby providing proper location and adhesive dimensions to secure the heater chip/nozzle plate assembly 12 in the chip pocket 36.

Once the chip/nozzle plate assembly 12 in FIG. 1 is attached to the cartridge body 14, the flexible circuit or TAB circuit 24 is attached to the cartridge body 14 using a heat activated or pressure sensitive adhesive 40 as shown in FIG. 4. Examples of useful adhesives 40 include, but are not limited to, phenolic butyral adhesives, acrylic based pressure sensitive adhesives such as AEROSET 1848 available from Ashland Chemicals of Ashland, Ky. and phenolic blend adhesives such as SCOTCH WELD 583 available from 3M Corporation of St. Paul, Minn. The adhesive 40 typically has a thickness ranging from about 25 to about 200 microns.

In accordance with another aspect of the invention, the ink jet print cartridge 10 can be produced by applying heat activated or pressure sensitive adhesive 40 to the cartridge body 14 and dispensing die bond adhesive 38 in the cartridge body 14. Chip/nozzle plate assembly 12 is attached to the flexible circuit 24 to form a circuit assembly. The circuit assembly is attached to the cartridge body 14 by placing the circuit assembly on the cartridge body 14 such that the flexible circuit contacts the adhesive 40 and the chip/nozzle plate assembly 12 contacts and displaces some of the die bond adhesive 38. Underfill material 42 may be dispensed directly above the gap between the flexible circuit 24 and the chip 32 to fill up a voided area. The underfill material may be stencil printed, screen printed or needle dispensed in accordance with the teachings of the present invention.

In order to protect the bond pads 34 and electrical traces 30 from ink corrosion, a protective overcoat layer or encapsulant 44 in FIG. 2 is applied to the traces 30 and bond pads 34. In accordance with one embodiment, the encapsulant is applied by stencil printing to provide a thin, consistent and smooth layer 46 of encapsulant 44. During the stencil printing process in accordance with certain embodiments, a stencil 48 having one or more apertures 50 corresponding to the locations on the inkjet print cartridge 10 requiring the protective overcoat layer is aligned with a specific location on the printhead. In accordance with certain embodiments, an automated stencil printing device can be used which provides the proper stencil 48 for a specific part and pattern of encapsulant 44. The cartridge 10 is properly located such that the apertures 50 in the stencil 48 correspond to the portions of the cartridge 10 requiring encapsulation. The cartridge 10 may be positioned by the external datums on the ink jet printhead body 14 to accommodate proper alignment. Alternatively, a vision system can be used to align the stencil 48 with the print cartridge 10. Fiducials on the stencil 48 are aligned to the fiducials on the print cartridge 10 thereby positioning the stencil 48 into proper alignment with the print cartridge 10 so that encapsulant can be stencil printed on to the print cartridge 10.

Once the print cartridge 10 has been properly aligned with the stencil 48, the encapsulant 44 is deposited on the stencil 48. A squeegee may be used to move the encapsulant material across the upper surface of the stencil thereby delivering the encapsulant material through the apertures 50 in the stencil 48 into contact with and covering the bond pads 34 and wires or traces 30. As the squeegee is moved across the stencil, the encapsulant 44 tends to roll in front of the blade, which desirably causes mixing and shear thinning of the encapsulant so as to attain desired viscosity to facilitate filling of the apertures 50 in the stencil 48. The encapsulant may be replenished on the stencil 48 with an automatic dispensing system.

The travel rate of the squeegee is the print speed. In accordance with one particular embodiment relating to stencil printed adhesive, the print speed typically ranges from about 1 to 10 inches/second (25.4 to 254 mm/s). Target print speed is 3 inches per second (76 mm/s). The force per unit length of squeegee on the printhead typically is about 1.1 lb/inch (0.026 Kg/mm) in accordance with one embodiment. The tolerance range typically is 0.1 lb/inch to 2 lb/inch. The squeegee contact angle with the stencil typically ranges from about 35 to 75 degrees. The target condition is about 50 degrees.

It is preferred that the layer 46 of encapsulant 44 applied over the connections 30 and 34 not extend too far above a plane defined by the surface 52 of the nozzle plate 20 (FIG. 3). Accordingly, in accordance with particular embodiments, the height of coating layer 46 above the nozzle plate 20 surface 52 ranges from about 0.001 to about 0.050 inches, more particularly from about 0.002 to about 0.015 inches, and in certain embodiments from about 0.003 to about 0.009 inches.

In accordance with certain embodiments of the present invention, the encapsulant material or other adhesive material could utilize one or more of the following cure mechanisms: thermal cure, induction cure, microwave cure, and/or IR cure. In accordance with a particular thermal cure system, after applying the encapsulant 44 to the exposed areas of the electrical traces 30 and bond connections 34, the encapsulant 44 is exposed to a temperature in excess of about 70° C., most preferably a temperature in the range of from about 80 to about 200° C. for a period of time ranging from about 5 minutes to about 2 hours. The selection of the cure temperature is dependent on the body material and the components on the printhead and the cure package in the adhesive.

For stencil printing applications, the encapsulant 44 preferably has a viscosity and shear thinning capability which enables placement of the encapsulant 44 on the connections in window 36 such that it effectively coats the traces 30 or wires and encapsulates and overlaps the ends of the nozzle plate 18 and flexible circuit or TAB circuit 24. The viscosity of the encapsulant is important for proper coverage and protection from ink corrosion. If the encapsulant 44 has too low a viscosity, it will be difficult to provide the coating layer 46 of encapsulant 44 which will remain in the desired location until curing of the encapsulant 44 is complete. Accordingly, the viscosity of the encapsulant 44 preferably ranges from about 25,000 to about 240,000 centipoise with a thixotropic index of from about 1 to about 10, more specifically from about 80,000 centipoise to about 180,000 centipoise with a thixotropic index of about 1.5 to about 3.0. Viscosity and thixotropic index as described in this paragraph are measured on a Brookfield cone and plate viscometer at 25° C. Viscosity is measured at a shear rate of 2.0 $s^{-1}$ and thixotropic index is measured at shear rates of 2.0 $s^{-1}$ and 20.0 $s^{-1}$. The thixotropic index refers to the ratio of the encapsulant's viscosity at 2.0 $s^{-1}$ to the viscosity at 20.0 $s^{-1}$ and provides a measure of the shear thinning characteristics of the encapsulant.

The encapsulant material 44 is typically characterized by adhesion to the polymeric materials used in the construction of various components of the ink jet print cartridge. Examples of such polymeric materials include, but are not limited to, polyimide materials such as those commercially available from E.I. DuPont de Nemours & Co. under the trademark KAPTON and from Ube under the trademark UPILEX.

Preferably, the encapsulant material 44 is resistant to ink and is capable of adequately protecting the exposed areas of the electrical traces 30 and bond connections 34. In accordance with certain embodiments, the encapsulant material 44 comprises a polymeric material which, after it has substantially solidified or cured, is capable of forming an effective mechanical and chemical protective barrier layer. In accordance with this embodiment, the smooth layer 46 of encapsulant 44 protects the bond connections from corrosion due to exposure to ink. The layer further protects the bond connections and exposed areas of the electrical traces 30 from damage caused by a conventional polymeric wiper (not shown) which forms part of the printer and moves across the nozzle plate 18 so as to remove ink therefrom. The encapsulant material 44 in accordance with certain embodiments of the invention has a glass transition temperature of greater than or equal to about 60° C.

Specific examples of adhesives useful herein include one part thermal cure epoxy adhesives such as Epibond 89713 from Huntsman Advanced Chemicals, Inc. and Loctite 221521 and Loctite 256579 both available from Henkel Technologies Corporation. Adhesives not specifically set out herein may also be used.

The stencil 48 can be made of various materials. Particularly useful examples include, but are not limited to plastics and stainless steels. Specific examples of useful plastics include but are not limited to, polyimides and fluoropolymer coated polyimides. The stencil thickness typically varies from about 0.001 to about 0.015 inches, more particularly from about 0.003 to about 0.009 inches.

Various materials can be used to produce the squeegee used in accordance with the present invention. Examples of useful materials include, but are not limited to, polyethylene, polyurethane, stainless steel and polytetrafluoroethylene (available under the trademark TEFLON® from E.I. DuPont de Nemours & Co.). The squeegee blades typically have a hardness of between about 0 to about 70 durometer, more typically about 50 durometer, on a Shore D scale or a Shore A equivalent.

Although the present invention is not limited to the particular application method, stencil printing offers a number of advantages over dispensing systems. The ability to apply a more consistent layer of encapsulant at precise locations increases yields and productivity. Taping the printhead is more easily accomplished with stencil printed encap due to its uniformity in location and height. Maintenance of the printhead between uses is improved with stencil printed encapsulant. The wiper which runs across the printhead cleans it more thoroughly with the lower, more uniform encapsulant. Multiple locations may be stencil printed in a single operation thereby reducing production costs. For example, a stencil can be used to seal the edge of the tab circuit to the cartridge at the same time it provides encapsulant over the electrical connections. The encapsulant can be provided in a number of configurations. Encapsulant can be stencil or screen printed in controlled, intricate designs, and in larger areas.

In accordance with the present invention, the adhesive to be applied, whether as an encapsulant, die attach adhesive, potting adhesive, etc. exhibits certain characteristics important to the proper positioning of the adhesive and the ability of the adhesive to maintain adhesive dimensions as applied. During inkjet printhead assembly, the adhesives on the various components go through a temperature ramp cycle from ambient to a desirable cure temperature which is then held isothermal for a period of time. Generally, the adhesives experience a drop in viscosity as the temperature is increased. Above a certain temperature and time, the adhesive begins to increase in viscosity as crosslinks are formed. Modulus continues to build up and eventually the gelation point is reached where the viscous material becomes viscoelastic. With time, the cure rate slows down as vitrification is reached.

In accordance with the present invention, various approaches are disclosed for a process capable of precisely locating an adhesive and maintaining adhesive dimensions. The ability to properly locate an adhesive and maintain dimensions of the applied adhesive depend on a number of factors including, but are not limited to, the drop in viscosity prior to onset of crosslinking, time to reach minimum viscosity, the induction time for crosslinking, the rate of crosslinking and the application temperature of the adhesive. A drop in viscosity prior to onset of crosslinking refers to the difference between the initial viscosity of the adhesive at the initial temperature, $T_i$, and the minimum viscosity which occurs before onset of crosslinking during thermal cure. Typically, better dimensional control of the applied adhesive occurs when the drop in viscosity is relatively low. In accordance with certain aspects of the present invention, the ratio of the initial viscosity to the minimum viscosity is from 1 to less than 2.1, more particularly from about 1 to about 1.5 and in accordance with more particular embodiments, approximately 1.

Initial viscosities determined from the rheology cure profiles for the adhesives useful in the present invention typically are between about 25,000 and 600,000 cps, more particularly between about 40,000 and 400,000 cps, at the initial temperature $T_i$. All viscosity measurements set forth herein relating to the rheology cure profile for the adhesive, unless specifically indicated otherwise, are measured with a Haake RS 75 Controlled Stress Rheometer using a parallel plate sensor in oscillation mode at a frequency of 1 Hz. Rheology profiles are typically determined over the temperature range from the initial temperature to the cure temperature having a temperature rise which simulates the rise in temperature experienced by the adhesive during manufacture. In accordance with a particular embodiment, the inkjet cartridge comprises a Noryl thermoplastic which, during production, is placed on a conveyor and sent through an oven set at 110° C. Due to the form factor of the part and thermal conductivity of the Noryl, the adhesive experiences a ramp up from 25° C. to 110° C. in 15 minutes and then is held for another 45 minutes at 110° C. Accordingly, the corresponding rheology scans are captured for this profile with a temperature rise of about 5.7° C./min. from the initial temperature to the cure temperature of 110° C. Other rheometers can be used to provide cure profiles simulating actual production conditions. Curve shapes for the cure profile may vary depending on the cure temperature, ramp rate, adhesive, etc . . . which are established so as to simulate production conditions.

Dimensions of the applied adhesive can also be improved by providing a shorter induction time for crosslinking. In other words, the applied adhesive is less likely to shift or creep if the time between the start of the cure cycle and the onset of crosslinking is relatively short. In accordance with certain aspects of the present invention, the onset of crosslinking occurs in less than about 10 minutes, more specifically the onset of crosslinking occurs in from 0 to about 5 minutes from the time the adhesive is applied.

In accordance with certain embodiments, the adhesive may be dispensed at temperatures above ambient or dispensed at or near ambient and then heated to lower the viscosity to reach a temperature which is either equal to or less than the minimum viscosity temperature prior to or immediately after application on the part. Examples of useful methods for increasing the temperature of the adhesive as it is being applied or immediately after application include, but are not limited to, localized IR heating, pulsed IR heating, laser heating, or pulsed laser heating which can be directly focused on the adhesive. The heating rate provided by these methods can be as high as 50° C./sec depending on the intensity of the IR/laser source and the absorptive coefficient of the adhesive. With such a rapid heating rate, the amount of time for the adhesive to reach minimum viscosity can be significantly reduced to less than 1 minute.

Then curing can be done through pulsed IR heating to maintain uniform curing temperature for complete crosslinking without overheating the adhesive. To avoid heating the printhead body by IR/laser, when an IR curable adhesive is stencil printed, the stencil mask should be IR/laser reflective to block the infrared or laser energy passing into the printhead material. The alternative is to use fiber optics or plastic light curtain to localize the light source on the desired area. In accordance with certain aspects of this embodiment of the invention, the application temperature of the adhesive may be between about 30° C. and lower than the cure temperature of the adhesive.

In accordance with certain aspects of the present invention, the adhesive is applied to a part which is above ambient temperature to immediately (within less than about 30 seconds) heat the adhesive to a temperature closer to the minimum viscosity temperature, preferably to at or about the minimum viscosity temperature.

The amount of time that the adhesive remains at the minimum viscosity before the onset of crosslinking is also a factor in the ability of the adhesive to maintain dimensions. Accordingly, the elapsed time from the point at which the minimum viscosity initially occurs to the point where the viscosity begins to increase will preferably be short and in accordance with certain embodiments will be less than about 2 minutes.

Cure rate of the adhesive also affects dimensional control. The rate of cure is calculated from a plot of sheer modulus G' vs. temperature or complex viscosity vs. temperature. Typically, the faster the cure rate, the better the dimensional control. However, if the cure rate is too fast, it can affect the ink resistance. Accordingly, the cure rate should be as fast as possible without adversely affecting adhesive properties.

The stencil printed adhesive on the inkjet printhead component typically will be cured at an elevated temperature. The cure temperature will depend on the adhesive as well as the composition of the inkjet print cartridge and the components. The cure temperature will typically be between about 70° C. and 200° C., more particularly from about 90° C. and 130° C., and will be held for a time sufficient to substantially cure the adhesive. For the Noryl inkjet cartridge described herein, a maximum cure temperature of approximately 110° C. is typically used.

Figure 5:
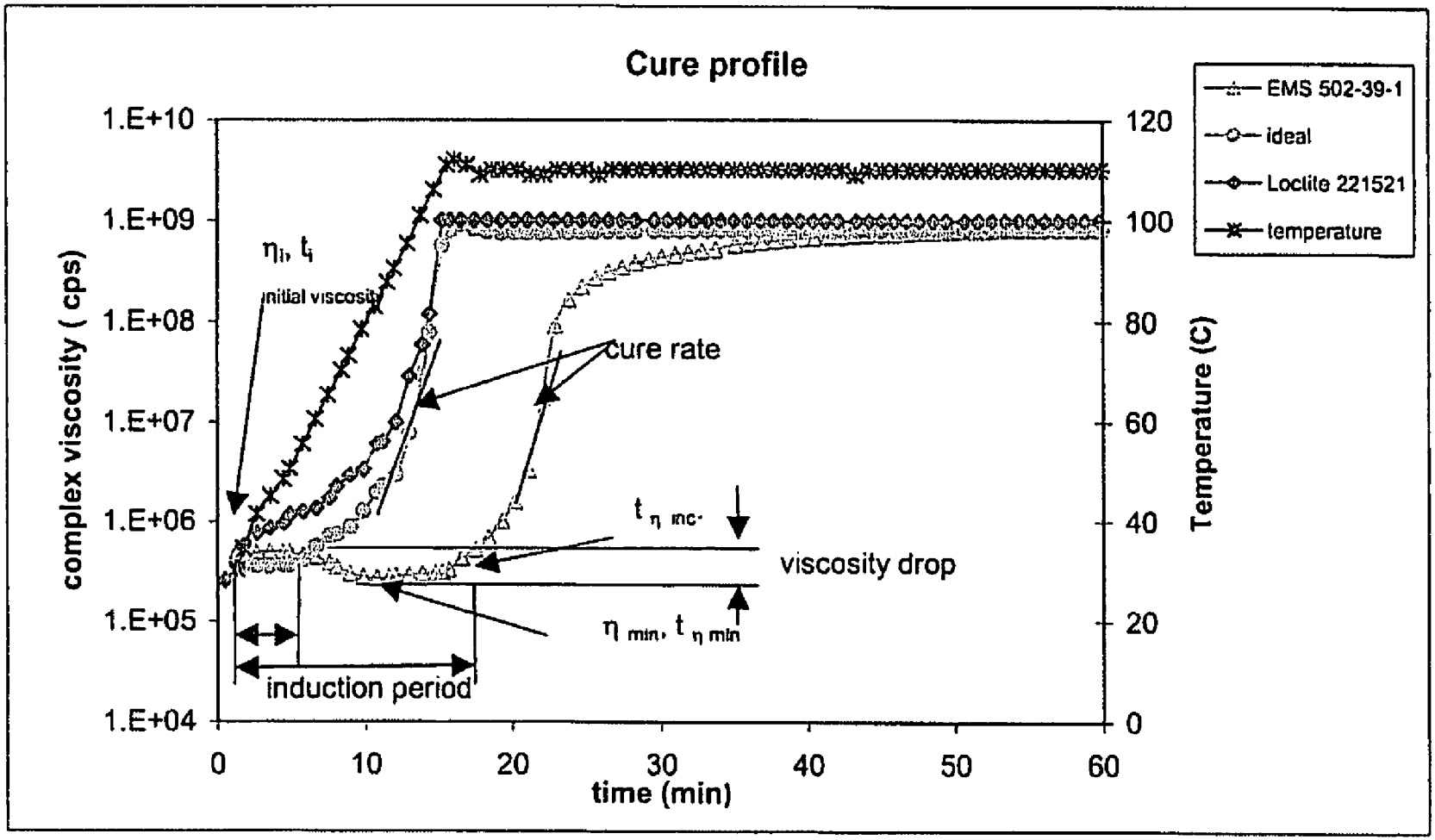
FIG. 5 is a graph illustrating cure profiles for various adhesives.

FIG. 5 illustrates cure profiles for various adhesives and describes key elements of the cure profile. EMS 502-39-1, an encapsulant adhesive available from EMS Inc., Delaware, Ohio, USA presents some decrease in viscosity as the temperature is increased and before crosslinking begins and does not provide as good of a dimensional control as the ideal adhesive for miniaturized silicon chips. The ideal adhesive exhibits little to no decrease in viscosity and the induction period is relatively short with a fairly steep slope depicting fast cure rate so that the applied adhesive can be properly located and hold dimensions before and during cure. Loctite 22521, for example, a one part epoxy, provides tight dimensions.

The invention is illustrated in more detail by the following non-limiting examples.

EXAMPLES

RHEOLOGY CURE PROFILES

TABLE 1

| Example | adhesive | initial viscosity $\eta_i$ (cps) | $t_i$ (min) | $t_{\eta\ min.}$ (min.) | min. viscosity $\eta_{min.}$ (cps) | $\Delta t = (t_{\eta inc.} - t_i)$ (min) | ratio: $\eta_i/\eta_{min.}$ | cure profile |
|---|---|---|---|---|---|---|---|---|
| 1 reference | EMS 502-39-1 | 569800 | 0.5 | 10.7 | 269500 | 17.9 | 2.1 | Prolonged time prior to onset of crosslinking; moderate cure rate after $t_{\eta inc.}$ |
| 2 reference | EMS 504-4 | 332300 | 1.74 | 975 | 98270 | 16 | 3.38 | Large viscosity drop; fast cure rate after prolonged length of time after viscosity drop |
| 3 | Loctite 256579 | 42670 | 1.0 | 2.5 | 25960 | 3 | 1.6 | Cure occurs shortly after small period of some viscosity drop; very fast cure rate |
| 4 | Loctite 221521 | 327500 | 1.7 | 1.7 | 327500 | 0 | 1.0 | No viscosity drop and beginning of cure is almost instantaneous with increase in temperature; fast cure rate |
| 5 | Epibond 8713 | 81220 | 1.3 | 1.3 | 81220 | 0 | 1.0 | No viscosity drop and fast cure rate |

Rheology profiles were determined using the following equipment and test parameters. Rheology profiles for other materials and cure conditions can be readily developed based on the actual cure conditions experienced during the manufacturing process.

Characterization of cure rheology of adhesives
Instrument: Haake RS75 Controlled Stress Rheometer
Mode: Oscillation
Frequency: 1 Hz
Sensor: 20 mm parallel plate
Gap: 1.0 mm
temp: initial temp. 25° C.
bath temperature control: water
cooling medium: air
Procedure: Follow calibration and operating procedures as outlined by manufacturer
Select appropriate elements and modules to reflect:
Cure profile: ramp from ambient to 110° C. in 15 minutes
hold at 110° C. for 45 minutes
then cool to ambient in 30 minutes
(this procedure simulates what the adhesive is subjected to in accordance a specific production environment—using Noryl SE1 bottle material)
Find Zero point
Dispense appropriate amount on the bottom plate
Bring the top plate down to the set height (1.0 mm)
remove the excess material gently
Make sure the material stabilizes at 25° C. initially
Start the test.
Monitor:
G' (shear modulus-Pa),
G" (loss modulus-Pa),
$\eta$*complex viscosity (Pa-sec or centipoise)
Graph: semi-log scale: complex viscosity vs. time
Report: $\eta_i$=initial viscosity (cps or Pa-s)
$t_i$=time at initial viscosity (min), start of cure cycle
$\eta_{min}$=minimum viscosity (cps or Pa-s)
$t_{\eta min}$=time to reach $\eta_{min}$ (min)
induction time=time at onset of crosslinking—$t_i$

DIMENSIONAL CONTROL

Various adhesives were tested to determine the ability of the adhesives to maintain printed dimensions. The following adhesives were stencil printed using a Kapton stencil with stencil aperture of 2.44 mm; at 3inches per sec; 2 kg force with an 8 inch squeegee of 50 Shore D durometer at an angle of 50 degrees, on a flat Upilex S substrate.

TABLE 2

| Example | adhesive | Mean width (mm) | Mean width cured (mm) | % over target |
|---|---|---|---|---|
| 1 reference | EMS 502-39-1 | 2.661 | 2.686 | 10 |
| 2 reference | EMS 504-4 | 2.731 | 2.765 | 13 |
| 3 | Loctite 256579 | 2.556 | 2.591 | 6 |
| 4 | Loctite 221521 | 2.604 | 2.632 | 8 |
| 5 | Epibond 8713 | 2.597 | 2.638 | 8 |

Adhesive dimensions of the printed samples were measured under a microscope after printing and then after cure. The cure of the adhesives occurred in a conveyorized convection oven at 110° C. for 1 hr. Adhesives having a % over target value of less than 10, more particularly about 8 or less are particularly useful.

Having described various aspects and embodiments of the invention and several advantages thereof, it will be recognized by those of ordinary skills that the invention is susceptible to various modifications, substitutions and revisions within the spirit and scope of the appended claims.

What is claimed is:

1. An inkjet print cartridge comprising:

a component of the inkjet print cartridge; and an applied adhesive on at least a portion of the component, wherein the applied adhesive is formed from an adhesive having a rheology viscosity ratio $\eta_i/\eta_{min}$ of from about 1.0 to less than 2.1;

wherein the adhesive is applied by aligning a compliant stencil with a specific position on the component such that at least one a aperture of the stencil aligns with the portion of the component to which the adhesive is to be applied and depositing the adhesive on the stencil, wherein the adhesive is delivered through the at least one aperture onto the portion of the component.

2. The cartridge of claim 1 wherein the adhesive has a minimum viscosity temperature, $T_{\eta min}$, as determined from the rheology cure profile and said adhesive is heated to $T_{\eta min}$ within less than about 10 minutes from the start of the cure cycle.

3. The cartridge of claim 2 wherein the rheology viscosity ratio $\eta_i/\eta_{min}$ is approximately 1.0.

4. The cartridge of claim 1 further comprising:

a flexible circuit, a heater chip and at least one electrical connection between the flexible circuit and the heater chip, wherein the portion of the component to which the adhesive is applied comprises the at least one electrical connection.

5. The cartridge of claim 4 wherein the adhesive comprises a polymeric encapsulant.

6. The cartridge of claim 5 wherein the polymeric encapsulant comprises a thermal cure epoxy adhesive.

7. The cartridge of claim 1 wherein the component is a cartridge body having a chip pocket and the adhesive is a die bond adhesive applied in the chip pocket.

8. The cartridge of claim 7 wherein a heater chip is in the chip pocket and the heater chip is attached to the cartridge body with the adhesive.

9. The cartridge of claim 1 wherein the adhesive has a cure temperature, $T_c$, of between about 90° C. and 130° C.

10. The cartridge of claim 1 wherein $\eta_i$ is between about 25,000 and 600,000 cps.

11. The cartridge of claim 1 wherein the adhesive was applied at an application temperature, $T_a$, of between about 20° C. and 30° C.

12. The cartridge of claim 1 wherein the adhesive was applied at an application temperature, $T_a$, of between about 30° C. and the cure temperature, $T_c$, for the adhesive.

13. The cartridge of claim 1 wherein the adhesive was applied to a component wherein the component was at a temperature above ambient.

14. A method for manufacturing an inkjet print cartridge comprising the steps of:

applying an adhesive onto at least a portion of a component of an inkjet print cartridge at an application temperature, $T_a$, by providing a compliant stencil having at least one aperture, aligning the stencil with a specific position on the component such that the at least one aperture aligns with the portion of the component to which the adhesive is to be applied, and depositing the adhesive on the stencil, wherein the adhesive is delivered through the at least one aperture onto the portion of the component; and heating the adhesive from an initial temperature, $T_1$, to a cure temperature for the adhesive, $T_c$;

wherein the adhesive has a rheology cure profile characterized by at least one of the following parameters:

a) rheology viscosity ratio $\eta_i/\eta_{min}$ of from 1.0 to less than 2.1, b) temperature of the adhesive is approximately equal to a minimum viscosity temperature for the adhesive, $T_{\eta min}$, within less than about 10 minutes from the start of the cure cycle, and c) viscosity of the adhesive increases within less than about 5 minutes from the start of the cure cycle.

15. The method of claim 14 wherein the adhesive temperature is approximately equal to $T_{\eta min}$ within from 0 to about 5 minutes from the start of the cure cycle.

16. The method of claim 15 wherein $T_a$, is approximately equal to $T_{\eta min}$.

17. The method of claim 14 wherein the adhesive comprises a polymeric encapsulant.

18. The method of claim 17 wherein the polymeric encapsulant comprises a thermal cure epoxy adhesive.

19. The method of claim 14 wherein the component is a cartridge body having a chip pocket and the adhesive is a die bond adhesive stencil printed in the chip pocket.

20. The method of claim 19 further comprising the step of:

positioning a heater chip in the chip pocket and attaching the heater chip to the cartridge body with the adhesive.

21. The method of claim 14 further comprising the step of:

curing the adhesive at a $T_c$ of between about 90° C. and 130° C.

22. The method of claim 14 wherein $\eta_i$, is between about 25,000 and 600,000 cps.

23. The method of claim 14 wherein $T_a$, is between about 20° C. and 30° C.

24. The method of claim 14 wherein $T_a$ is between about 30° C. and Tc.

25. The method of claim 24 further comprising heating the adhesive after application to a temperature of between about 30° C. and $T_c$ using a method selected from the group consisting of localized IR heating, pulsed IR heating, laser heating, pulsed laser heating or combinations thereof.

26. A method for manufacturing an inkjet print cartridge comprising the steps of:

providing an inkjet print cartridge having an adhesive receiving portion;

providing a stencil having an aperature;

aligning the stencil with a position on the inkjet print cartridge so that the aperature is aligned with the adhesive receiving portion of the inkjet print cartridge; and depositing an adhesive through the aperature of the stencil so that at least some of the adhesive is applied to the adhesive receiving portion of the inkjet print cartridge.

27. The method of claim 26 further comprising the step of:

heating the adhesive from an initial temperature to a cure temperature for the adhesive subsequent to depositing the adhesive.

28. The method of claim 27 wherein the adhesive comprises a polymeric encapsulant.

29. The method of claim 28 wherein the polymeric encapsulant comprises a thermal cure epoxy adhesive.

30. The method of claim 26 further comprising the step of:

positioning a heater chip adjacent the adhesive receiving portion of the inkjet print cartridge subsequent to depositing the adhesive to mount the heater chip to the inkjet print cartridge.

* * * * *